US008291989B2

(12) United States Patent
Kilgore

(10) Patent No.: US 8,291,989 B2
(45) Date of Patent: Oct. 23, 2012

(54) RETRIEVAL METHOD FOR OPPOSED SLIP TYPE PACKERS

(75) Inventor: Marion Dewey Kilgore, Terlingua, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 410 days.

(21) Appl. No.: 12/641,887

(22) Filed: Dec. 18, 2009

(65) Prior Publication Data

US 2011/0147013 A1 Jun. 23, 2011

(51) Int. Cl.
*E21B 33/129* (2006.01)

(52) U.S. Cl. ..... 166/387

(58) Field of Classification Search ..... 166/382, 166/387, 118, 134
See application file for complete search history.

(56) References Cited

U.S. PATENT DOCUMENTS

| | | | | |
|---|---|---|---|---|
| 4,457,369 | A | 7/1984 | Henderson | |
| 4,664,188 | A | 5/1987 | Zunkel | |
| 5,046,557 | A | 9/1991 | Manderscheid | |
| 5,151,203 | A | 9/1992 | Riley | |
| 5,224,540 | A | 7/1993 | Streich | |
| 5,271,468 | A | 12/1993 | Streich | |
| 5,341,874 | A | 8/1994 | Wilson | |
| 5,433,269 | A | 7/1995 | Hendrickson | |
| 5,720,343 | A | 2/1998 | Kilgore | |
| 5,727,632 | A | 3/1998 | Richards | |
| 5,884,699 | A | 3/1999 | Mullen | |
| 5,941,306 | A | 8/1999 | Quinn | |
| 5,944,102 | A | 8/1999 | Kilgore | |
| 6,056,052 | A | 5/2000 | Mullen | |
| 6,102,117 | A | 8/2000 | Swor | |
| 6,112,811 | A | 9/2000 | Kilgore | |
| 6,267,180 | B1 | 7/2001 | Gazda | |
| 6,302,217 | B1 * | 10/2001 | Kilgore et al. | 166/382 |
| 6,318,460 | B1 | 11/2001 | Swor | |
| 6,478,093 | B1 | 11/2002 | Hilts | |

(Continued)

FOREIGN PATENT DOCUMENTS

EP 1030031 8/2000

OTHER PUBLICATIONS

PCT International Search Report, PCT/US2010/056361, issued Aug. 11, 2011.

(Continued)

*Primary Examiner* — David Andrews
(74) *Attorney, Agent, or Firm* — Booth Albanesi Schroeder LLC; Peter V. Schroeder; John F. Booth

(57) ABSTRACT

A method is provided which releases and retrieves an opposed slip downhole tool by reducing the compressive forces on the sealing elements prior to unsetting the slip assemblies. Further, the method does so without damaging the slip assemblies. The method provides for the retrieval of the entire downhole tool including all of its component parts, requiring but a single trip within the wellbore. When the tool is to be retrieved, the sealing element is disengaged from the casing by relaxing the compression forces on the sealing element. Then the slip assemblies are disengaged from the casing such that the slip assemblies are no longer in gripping engagement with the casing. The tool is then retrieved from the wellbore. The step of disengaging the sealing assembly can be performed by radially contracting the sealing element with or without longitudinally expanding the sealing element.

20 Claims, 17 Drawing Sheets

U.S. PATENT DOCUMENTS

| | | | |
|---|---|---|---|
| 6,481,496 | B1 | 11/2002 | Jackson |
| 6,481,497 | B2 | 11/2002 | Swor |
| 6,629,563 | B2 | 10/2003 | Doane |
| 6,691,788 | B1 | 2/2004 | Dearing |
| 6,860,326 | B2 | 3/2005 | Kilgore |
| 7,055,596 | B2 | 6/2006 | Kilgore |
| 7,080,693 | B2 | 7/2006 | Walker |
| 7,198,110 | B2 | 4/2007 | Kilgore |
| 7,487,832 | B2 | 2/2009 | Read, Jr. |
| 2007/0062708 | A1 | 3/2007 | McGregor |

OTHER PUBLICATIONS

PCT International Search Report and Written Opinion for PCT/US2010/056361, Aug. 11, 2011.

* cited by examiner

RETRIEVAL METHOD FOR OPPOSED SLIP TYPE PACKERS

FIELD OF INVENTION

The invention relates generally to equipment utilized in conjunction with subterranean wells and, more particularly, to retrieving packers or other downhole tools having opposed slip assemblies to secure the tool in a cased wellbore. This invention would be especially useful with high performance tools designed for use in high pressure and high temperature environments.

BACKGROUND OF THE INVENTION

Current practices used to unset and retrieve opposed slip type packers and other tools, such as plugs, particularly those used in extreme pressure and temperature environments, have not proven to be efficient or reliable due to various limitations. Further, the methods for retrieving such tools often result or require the destruction of the tool or parts thereof, such as by drilling, milling and the like.

Various patents describe mechanisms for setting, unsetting and retrieving downhole tools such as packers, including U.S. Pat. Nos. 4,151,875 to Sullaway, 5,224,540 and 5,271,468 to Streich, 5,727,632 to Richards, 7,080,693 to Walker, and 7,198,110 to Kilgore, all of which are hereby incorporated for all purposes.

It is desirable to provide a tool release and retrieval method which results in a more efficient and reliable retrieval process. Further, it would be desirable to retrieve the entire downhole tool, including all of its component parts. Further, it would be desirable to release and retrieve the entire tool with a single trip within the wellbore.

SUMMARY OF THE INVENTION

A method is described, which provides for the release and retrieval of an opposed slip type down hole tool by reducing the compressive forces on the sealing elements prior to unsetting the upper slip assembly. Further, the method does so without damaging the slip assemblies. The method provides for the retrieval of the entire downhole tool, including all of its component parts, requiring but a single trip within the wellbore.

A method is described for utilizing an opposed-slip type downhole tool in a subterranean wellbore having a casing. The tool is positioned in a subterranean wellbore having a casing. The tool has upper and lower slip assemblies positioned on opposite sides of a sealing assembly. The sealing assembly has at least one compressible, annular sealing element. The tool is then set in the wellbore by radially expanding the slip assemblies into gripping engagement with the casing, and by longitudinally compressing and radially expanding the sealing element into sealing engagement with the casing. When the tool is to be retrieved, the sealing element is disengaged from the casing by relaxing the compression forces on the sealing element. Then the slip assemblies are disengaged from the casing such that the slip assemblies are no longer in gripping engagement with the casing. The tool is then retrieved from the wellbore.

The step of disengaging the sealing assembly can be performed by radially contracting the sealing element with or without longitudinally expanding the sealing element.

In a preferred method, the tool includes a sealing element retainer assembly having a sealing element retainer, which is moved with respect to the sealing element to reduce the compression forces on the sealing element. The sealing element retainer can be moved longitudinally or otherwise. Movement of the sealing element retainer results in relaxation of, or reduction of compressive forces in, the sealing element. In a preferred embodiment, the sealing element retainer is an annular member in sliding engagement with a mandrel of the tool, the sealing element retainer connected to the upper wedge assembly by a releasable connection. The sealing element retainer is released to move with respect to the upper wedge assembly during the step of disengaging the sealing element. In the exemplary embodiment, the releasable connection includes a toothed, collapsible C-ring, the teeth of which engage a corresponding toothed portion of the upper wedge assembly. The C-ring cooperates with and collapses into a reduced-diameter portion of the outer surface of the mandrel during the step of disengaging the sealing element.

In an alternative embodiment, the sealing element is relaxed by allowing radial contraction without allowing longitudinal expansion. The sealing element retainer is moved longitudinally during the step of disengaging, the movement of the retainer relaxing the compression force acting against the interior surface of the sealing element by aligning a reduced-diameter portion of the mandrel with the sealing element, thereby reducing the compression force on the sealing element and allowing the sealing element to relax.

Alternate embodiments are described and these and other features, advantages, benefits and objectives of the present invention will become apparent to one of ordinary skill in the art upon careful consideration of the detailed description of representative embodiments of the invention herein below and the accompanying drawings.

In the following description of the tool and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

DETAILED DESCRIPTION OF THE PREFERRED EMBODIMENT

While the making and using of various embodiments of the present invention are discussed in detail below, a practitioner of the art will appreciate that the present invention provides applicable inventive concepts, which can be embodied in a variety of specific contexts. The specific embodiments discussed herein are illustrative of specific ways to make and use the invention and do not delimit the scope of the present invention.

Figure 1:
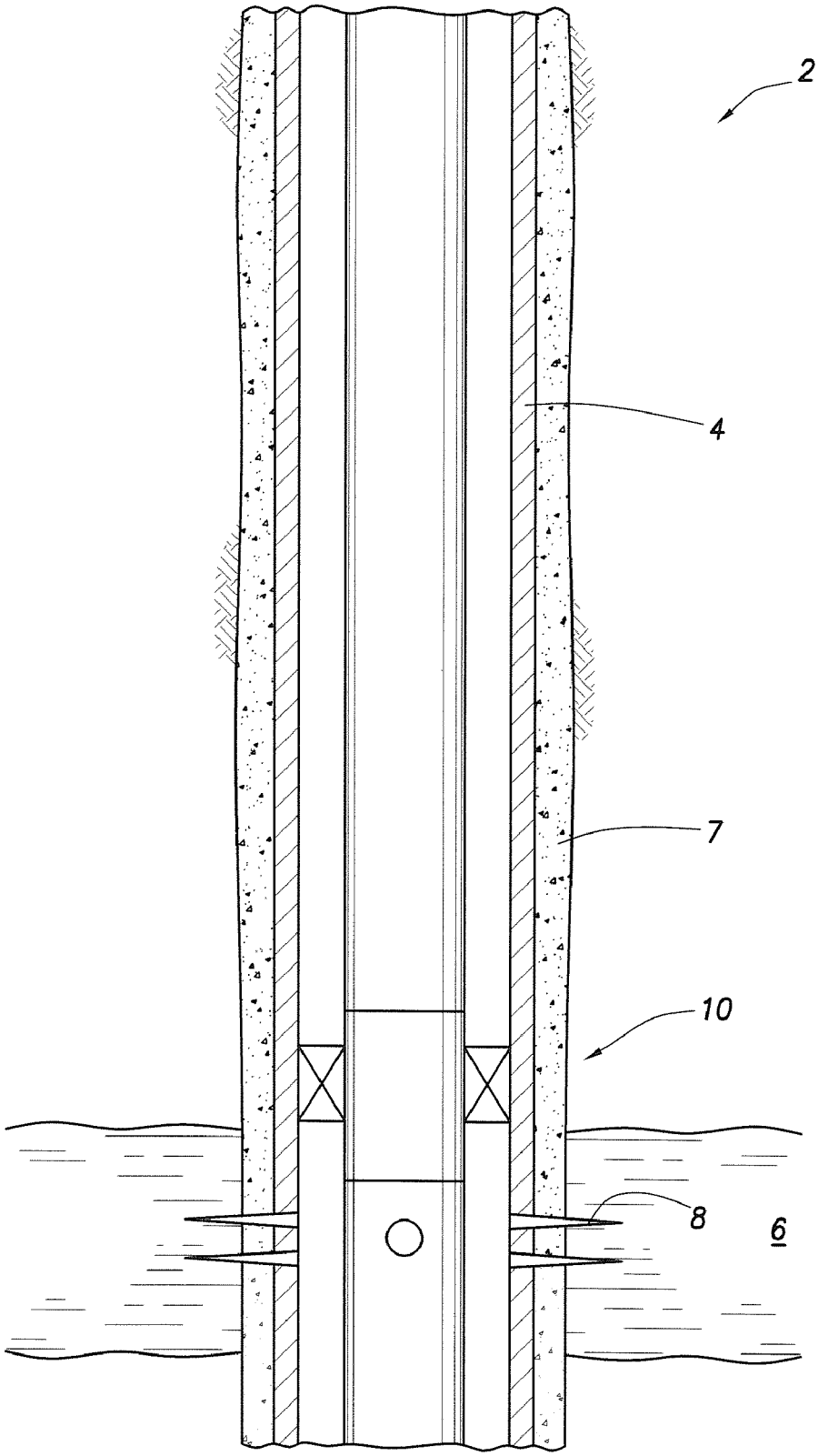
FIG. 1 is a cross-sectional view of a cased wellbore extending through a subterranean zone with a tool embodying the principles of the invention in a set position in the wellbore.

FIG. 1 is a cross-sectional view of a wellbore 2 extending through a production zone 6 of a subterranean formation 9. The wellbore 2 has a casing 4 which has been cemented 7 in place. Perforations 8 extend into the production zone 6. An exemplary tool 10 of the invention is shown in a downhole position in the wellbore, in a set position in engagement with the casing 4.

Representatively illustrated in FIGS. 2-4 is a cross-sectional view of a downhole tool 10, which embodies principles of the present invention. As explained in detail herein, FIGS. 2A-E show the tool 10 in a run-in position, FIGS. 3A-E show the tool 10 in a set position, and FIGS. 43A-F show the tool in a released or un-set position.

The tool 10 described herein is an example of an "opposed slip" type well tool which may be run, set, unset and retrieved in a wellbore having a casing using the principles of the invention. The tool 10 is a well tool of the type which, when set, dually grips the wellbore preventing either upward or downward tool movement. The opposed upper and lower slip assemblies function to anchor the tool against movement in both axial directions. The gripping or anchoring function is performed by the upper and lower slip assemblies 20 and 60 when in the set position, as seen in FIGS. 2A-E, wherein the slip assemblies are in a radially expanded set position to engage the casing of the wellbore. Further, the opposed slip type tool positions the upper and lower slip assemblies 20 and 60 on opposite sides of the sealing assembly, or packer element assembly, 40. The sealing assembly 40, when in the radially expanded set position, sealingly engages the casing of the wellbore preventing fluid flow longitudinally between the casing and the tool mandrel 12.

Consequently, the use of the term "opposed slip type tool" as used herein is limited to downhole tools having an upper and lower slip assembly on opposite sides (above and below) a sealing assembly. The tool 10 is illustrated as a packer, however, the invention applies equally to all opposed slip type tools having slip assemblies above and below a sealing assembly, including plugs, valves, etc., as will be apparent to one of skill in the art. The invention lies in the methods and apparatus for releasing and retrieving the tool as claimed, rather than in the function of the tool when set in the wellbore.

The terms "uphole" and "upward" refer to the direction toward the wellbore surface. The terms "downhole" and "downward" refer to the direction of away from the wellbore surface. While it is anticipated that the surface is generally upward from any downhole location, the tool may be utilized in a deviated or horizontal wellbore, in which case the terms refer to the directions indicated rather than relative vertical placement.

When in the set position, compressive forces are "trapped" in the sealing assembly 40. That is, compressive forces are applied to the sealing assembly during the setting process in order to radially expand the sealing elements 42 into sealing engagement with the wellbore. These compressive forces remain acting on the sealing assembly while the tool is in the set position, the relative spacing of the upper and lower slip assemblies maintaining the sealing assembly in a radially expanded and longitudinally shortened position. After being set in the wellbore, and prior to retrieval, the invention enables the compressive forces on the sealing assembly 40 of the tool 10 to be reduced or relaxed before unsetting the slip assemblies 20 and 60.

This method of relaxing the sealing assembly before release of the slip assemblies results in a more reliable and efficient process of retrieval of the downhole tool. The methods included in the invention also permit the full retrieval of the packer and all of its components as a single unit. The methods also permit, but do not require, the release and retrieval of the well tool in a single trip within the wellbore.

As used herein the term "set" is used to refer to an operation producing a gripping and sealing engagement between the well tool and the casing of the wellbore. The "set position" is used to refer to the tool when in a position having the slip assemblies in a radially expanded position in gripping engagement with the casing and the sealing assembly radially expanded and in sealing engagement with the casing. The terms "release" or "unset" are used to refer to an operation, which moves the tool out of gripping and sealing engagement with the casing of the wellbore to permit removal or retrieval of the tool from the wellbore. While it is preferable that the unsetting of the tool will move the tool out of all contact with the casing, it is recognized that this may not always be the case. If the wellbore is horizontal, or other than vertical, the tool may still contact the casing as it lies in the wellbore. Further, the sealing assembly, once expanded, may not radially reduce in diameter sufficiently to prevent all contact with the casing. However, the sealing assembly must be unset, or radially contract, enough to allow relatively easy removal from the well. The term "nm-in position" refers to the tool when in an initial position for running the tool into the wellbore, wherein the slip assemblies are radially contracted and the sealing assembly radially contracted. Similarly, the term "unset position" or "released position" refers to the tool when after being in the set position, is in a position with the slip assemblies radially contracted and the sealing assembly radially contracted.

Turning to FIGS. 2A-E, the tool 10 includes a mandrel 11 on which essentially all other components are carried or assembled. The tool 10 includes an upper sub 16, an upper slip assembly 20, an upper wedge assembly 30, sealing assembly 40, lower wedge assembly 50, lower slip assembly 60, packer element retaining assembly or "prop" assembly 70, setting assembly 100 and lower sub 18. The major components described above make up the primary components of the tool 10 according to an embodiment of the present invention. More details of the tool 10, its methods of operation, and various methods of reducing the compressive forces on the packer sealing elements 42 prior to unsetting the slip assemblies 20 and 60 are provided below.

In FIGS. 2A-E, the tool 10 and its various components are shown in their run-in positions, that is, the position when the tool 10 is run-in or lowered into a well in preparation for setting the tool 10 in the wellbore casing. The various components of the tool 10 are positioned to allow lowering into the casing without interference. The upper and lower slip assemblies 20 and 60 have not yet been radially expanded and are at a first diameter smaller than when in the set position, discussed below. Similarly, the sealing assembly 40 has not yet been radially expanded into a set position and is at a first reduced diameter. The setting assembly 100 has not been actuated.

The mandrel 11 is shown threadedly connected to an upper sub 16 and a lower sub 18. Alternately, the tool and subs can be formed as a single solid piece. The upper sub 16 is designed for connection to a tubing string, coiled tubing or the like as is known in the art. Further or alternately, the upper sub is configured to receive and releasably connect to a stinger, setting tool, actuating or operating tool, hydraulic actuator, or other well tool as is known in the art. The lower sub 18 can also be configured as desired.

The upper and lower slip assemblies 20 and 60 have upper and lower slip elements 22 and 62, respectively. In the embodiment shown, the slip elements are part of a circumferentially continuous, axially-slotted, barrel-type slip of the type known in the art. However, it is to be clearly understood that the slip assemblies may be differently configured without departing from the principle of the present invention. For example, the slip elements 22 can be comprised of a plurality or series of slip elements which are independent and separated from one another, or partially segmented and movably joined to one another, circumferentially discontinuous, divided, slotted, etc. The slip assemblies may include further elements not shown, such as retaining rings or devices, to maintain the slips in the run-in position until setting the tool. The slip assemblies 20 and 60, as shown have shear mechanisms 26 and 66, to maintain the slip assemblies in their run-in position. The shear mechanisms, here pins, are sheared as an initial step in setting the tool to allow relative longitudinal motion between the slip elements and the mandrel. Other methods of maintaining the slip assemblies in a run-in position are known in the art and may be employed. The upper slip assembly 20 further includes an upper slip support 25, in this case an enlarged portion of the lower end of the upper sub 16. The slip support 25 abuts the upper end of the upper slip elements 22, maintains the relative positions of the assemblies during run-in, and communicates setting force during setting. In this case, the upper slip support 25 does not move relative to the mandrel 12 during setting. Other slip support mechanisms are known in the art and may be used.

The slip assemblies 20 and 60 have a plurality of longitudinal slots 24 and 64, respectively. The slots 24 of the upper slip assembly 20 cooperate with lugs 14, which are integrally formed on the mandrel 12 and extend radially from the mandrel body into the slots. Each of the slots 24 has a closed upper end 27, which the lugs 14 will contact during the unsetting or releasing step. As the mandrel 12 is moved longitudinally during the unsetting or disengaging process, the lugs move longitudinally with respect to the upper slip assembly 20. The lugs 14 contact the upper ends 27 of the slots 24 of the barrel slip and unset the slip assembly. That is, the slips 22 are pulled off of the wedges of the wedge assembly 30. The slip assembly then radially contracts, thereby disengaging with the casing wall. The tool 10 is designed such that the upper slip assembly is not unset or disengaged until after the sealing assembly is disengaged from the casing. The lugs 14 move longitudinally along the slots 24 as the groove 78 on the mandrel is moved into alignment with the release mechanism 75, as described below, but do not contact the upper ends of the slots 24 until after the groove and release mechanism are aligned and the prop member 72 telescopes with respect to the upper wedge assembly 30. Thus, the upper slip assembly is not disengaged until after the sealing assembly is disengaged.

Each of slip elements 22 and 62 contains a series of serrated outwardly protruding teeth 28 and 68, respectively, thereon for gripping the casing wall or other conduit within the wellbore. The teeth or gripping structures 28 and 68 of the slip assemblies 20 and 60 may be of any design known in the art, such as integrally formed on the slip elements, separately attached to the assemblies (such as "button slips"), etc. Incorporated herein by reference for all purposes is U.S. Pat. No. 5,224,540 to Streich which describes and refers to various setting mechanisms, slip configurations, slip supports, and teeth among other things.

The upper wedge assembly 30 is carried on the mandrel 12. The upper slip assembly 20 and the upper wedge assembly 30 have cooperating sloped surfaces 29 and 32, which cause the upper slip assembly 20 to expand radially as the upper wedge assembly 30 is moved longitudinally relative to the upper slip assembly 20. To "expand radially", as used herein in reference to the upper 20 and lower 60 slip assemblies, means to expand their outer diameters rather than suggesting a volumetric increase of the components. The radial expansion of the upper slip assembly 20 causes their gripping surfaces 28 to come into contact with the interior surface of the wellbore casing. With sufficient radial expansion, the upper slip assembly 20 becomes grippingly engaged with the casing, preventing upward movement of the tool 10 in the wellbore.

Similarly, the lower wedge assembly 50 is carried on the mandrel 12. The lower slip assembly 60 and the lower wedge assembly 50 have cooperating sloped surfaces 62 and 52, which cause the lower slip assembly to expand radially as the lower wedge assembly is moved longitudinally relative to the lower slip assembly. This radial expansion causes the lower slip assembly 60 to become grippingly engaged with the wellbore casing as described with respect to the upper assembly above. The lower slip support 65 is shown as abutting the lower end of the lower wedge assembly 60. The slip support, as described above, is utilized to maintain the wedge and slip assemblies in position during run-in and to communicate setting force to the wedge and slip assemblies during setting. In this case, the lower slip support 65 moves upward relative to the mandrel 12 during the setting process. The lower slip support 65 is shown having a shearing mechanism 26 to hold the slip support in place until the setting process is begun.

Figure 2A:
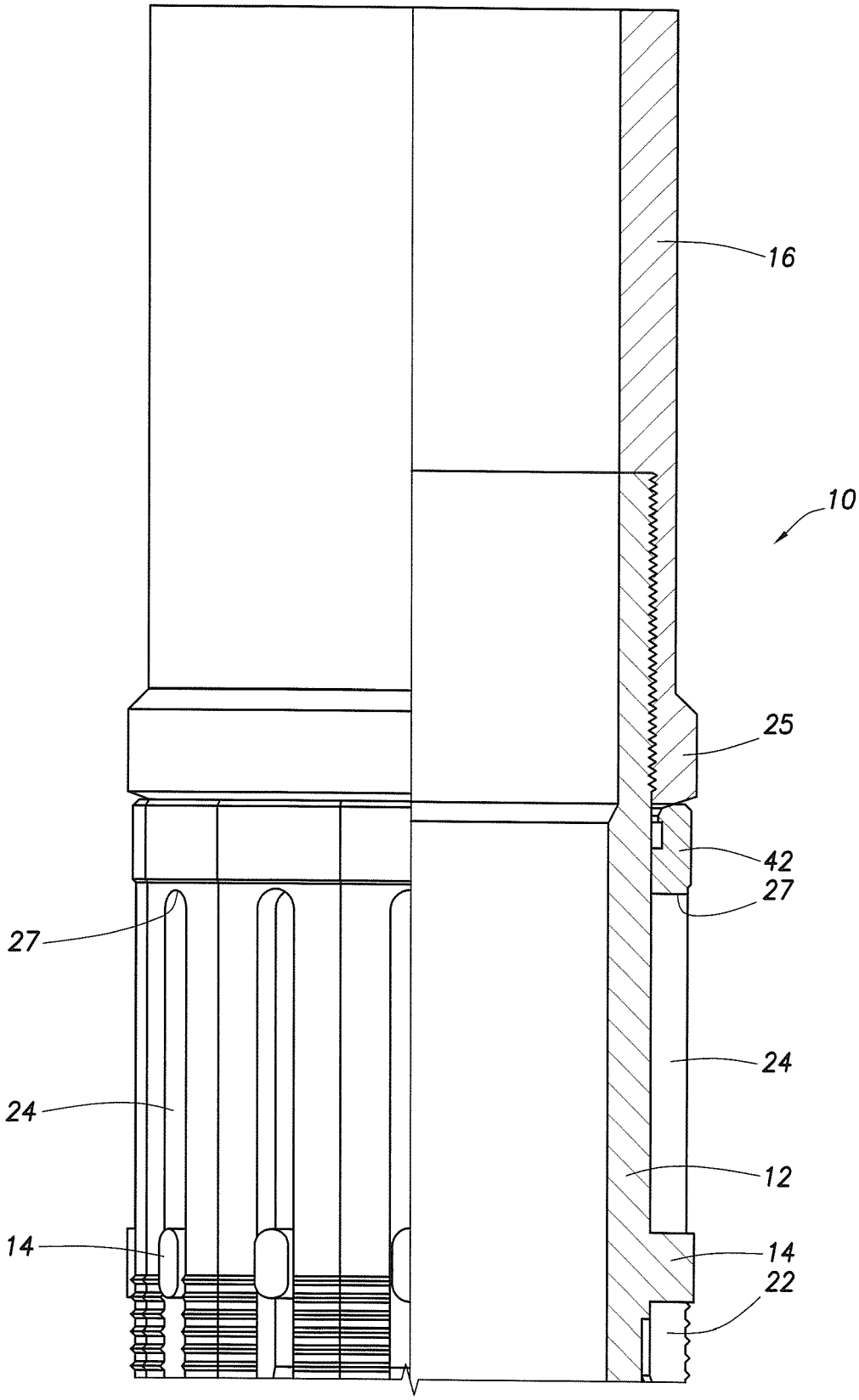
FIGS. 2A-2E are partial cross-sectional views of an opposed slip type tool of an embodiment of the invention in a run-in position.
Figure 2B:
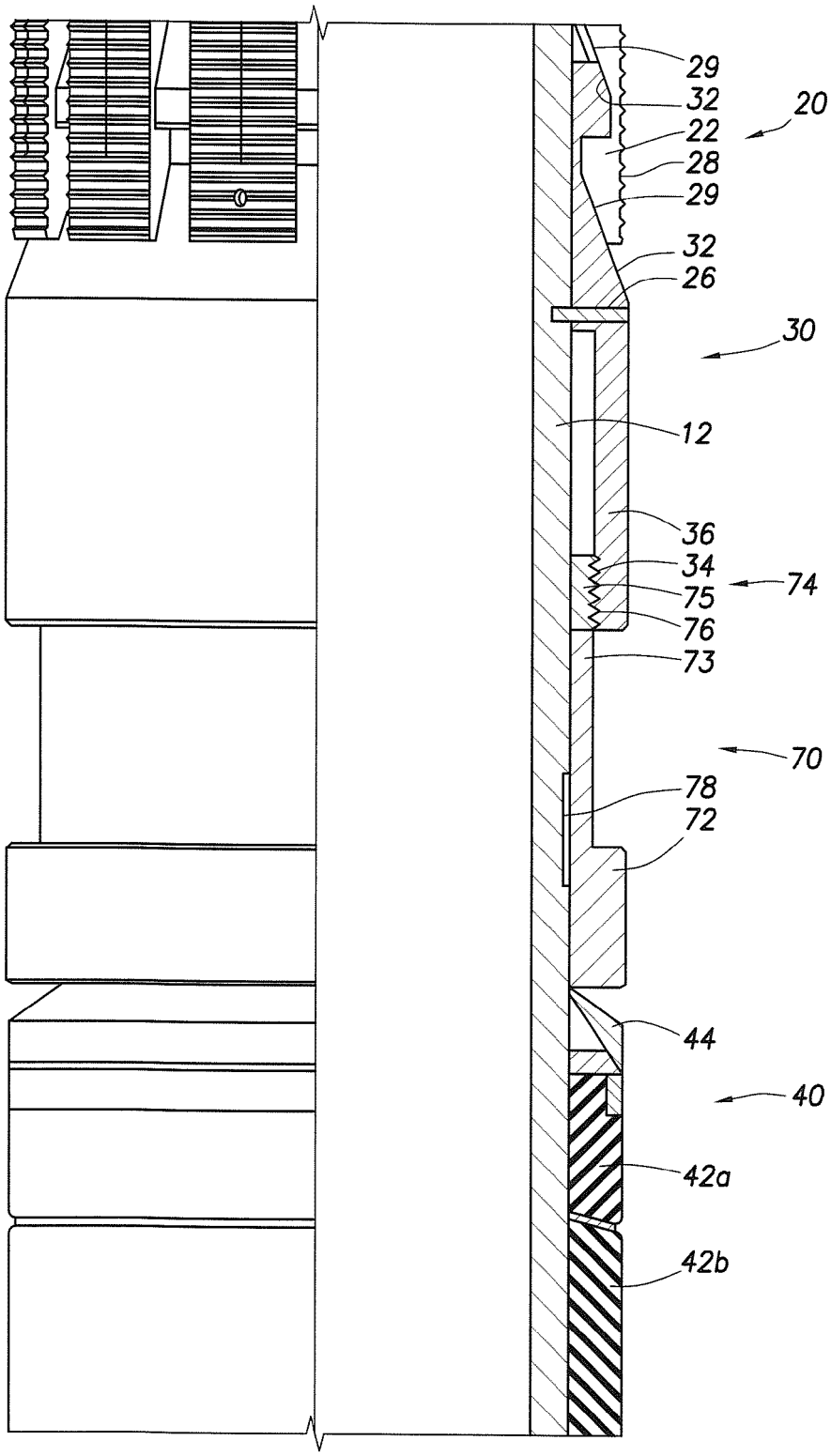
Figure 2C:
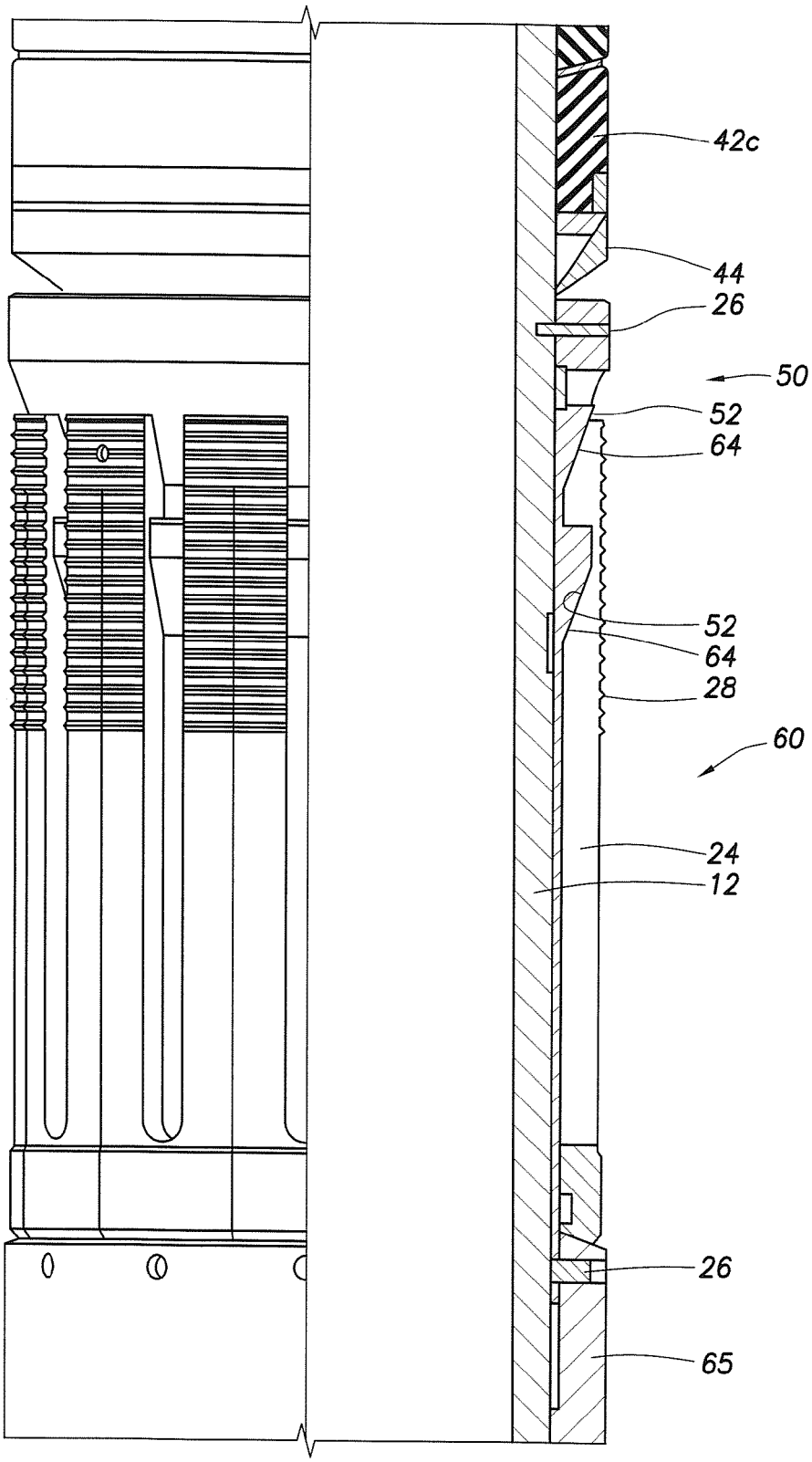
Figure 2D:
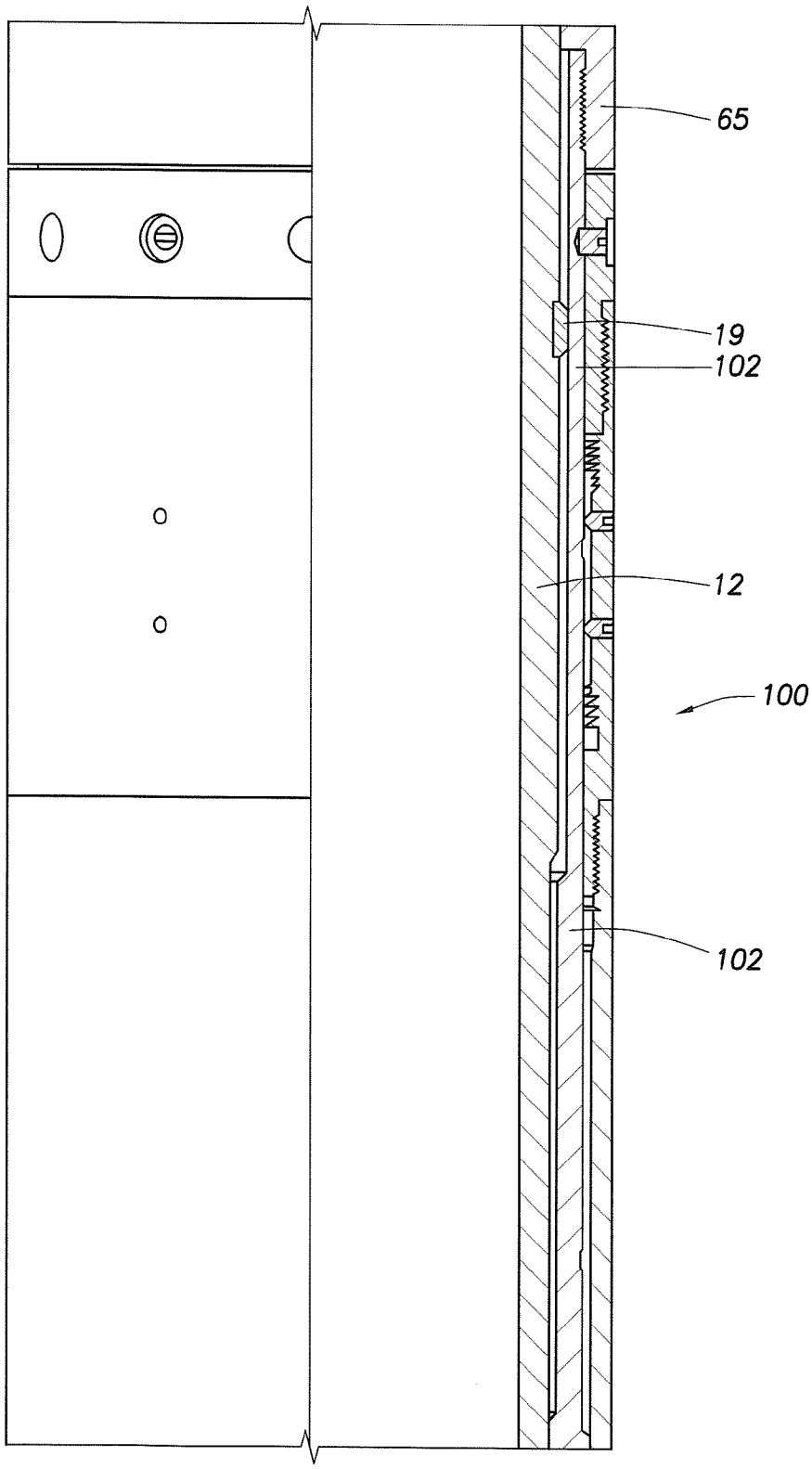
Figure 2E:
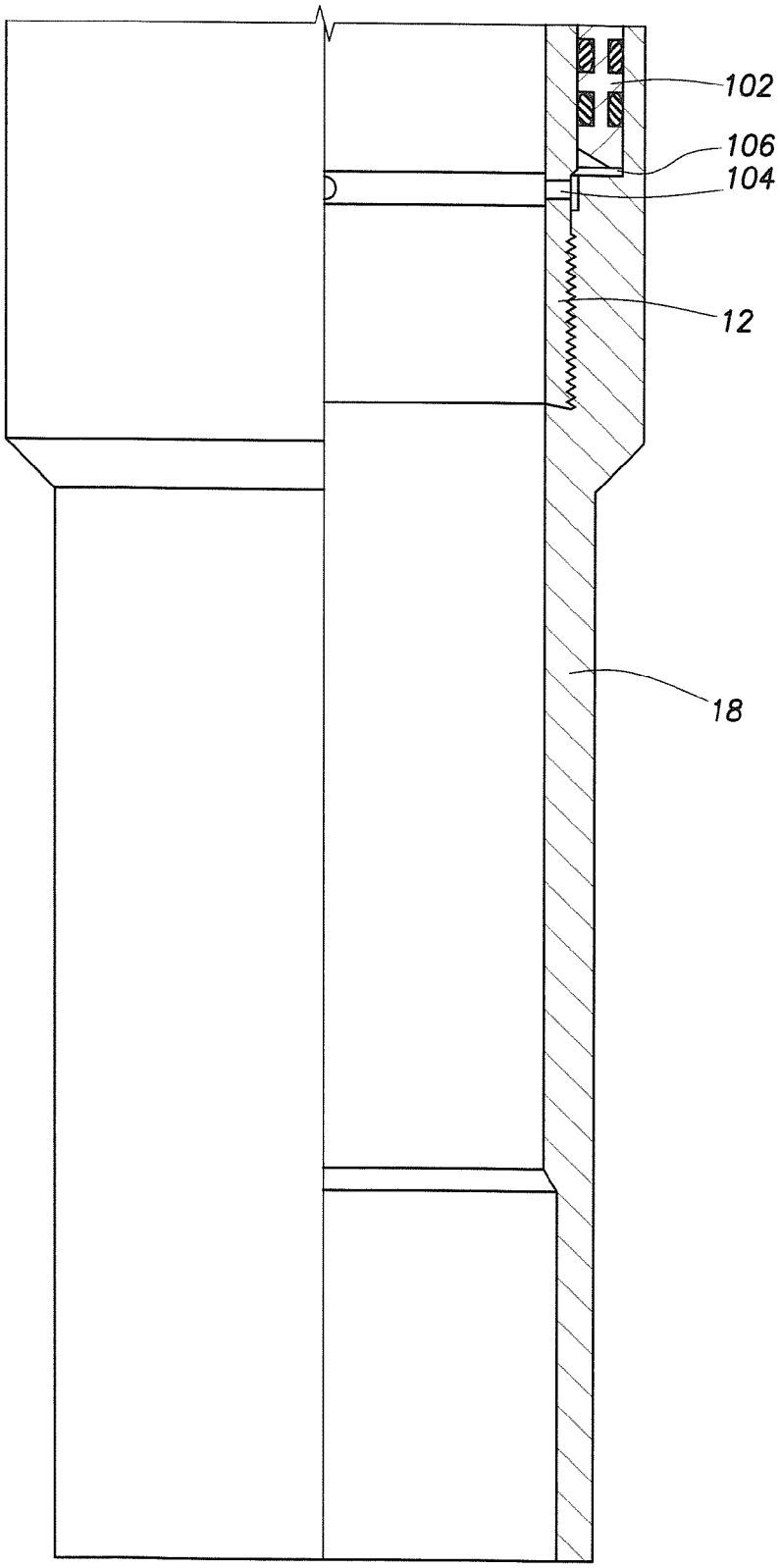

As shown in FIG. 2A, the sealing assembly 40 is mounted circumferentially on the mandrel 12 between the upper 20 and lower 60 slip assemblies. Also shown in FIGS. 2A-E, the sealing assembly 40, or packer element assembly, includes a plurality of sealing elements 42*a-c*. These sealing or packer elements may typically be made of an elastomeric material such as rubber but may be constructed of other materials familiar to those skilled in the art. It is to be understood that the sealing assembly 40 may have one or more sealing elements 42. Further, the sealing assembly 40 is shown having deformable support members 44, which function as anti-extrusion rings when in the set position.

In the run-in position, the sealing elements 42 are carried on the packer element assembly in an unexpanded position having a radial diameter smaller than when in the set position. In the set position, as shown in FIGS. 3A-E, the sealing elements 42 are expanded outward radially by the relative movement of the upper and lower wedge assemblies toward one another. This longitudinal shortening of the sealing assembly 40 results in simultaneous radial expansion of the sealing assembly. The sealing elements 42 are radially expanded into sealing engagement with the wellbore casing. This sealing engagement may not provide an absolute seal but does prevent any significant fluid flow between the outside of the sealing assembly and the interior surface of the wellbore casing at typical, or even severe, downhole temperatures and pressures. The sealing elements 42 effectively seal the annular space between the mandrel 12 and the casing.

FIGS. 3A-E depict the packer 10 in the "set" position. Because the opposed slip assemblies grip and act in opposite directions, they tend to move closer together during wellbore use, especially with reversals in the differential pressure across the tool. This "cinching up" is beneficial in that it increases the gripping forces on both the slip assemblies and the sealing forces on the sealing elements, thus holding the tool more firmly in the set position. The cinching movement, however, also increases the magnitude of the compression forces in the sealing elements 42. The movement also increases the tension in the portion of the wellbore casing between the two slip assemblies 20 and 60. The compression forces within parts of the tool 10 and tension forces within parts of the wellbore casing make the unsetting and retrieval of the packer more difficult.

Once the tool 10 has been lowered into the desired position in the wellbore, that is, a selected distance from surface, the tool 10 is set or moved into a set position, as seen in FIGS. 3A-E, by actuating the setting assembly 100. The setting assembly 100 is actuated to move the tool components into their set positions. The setting assembly 100 is shown as a hydraulic setting assembly formed as part of the tool 10 at its lower end. The setting assembly 100 and method of setting will not be described in detail herein since they are generally known and understood in the art. The setting assembly 100 can be an electrical, mechanical, electro-mechanical, or hydraulic setting assembly (as shown), or of other type as known in the art. The hydraulic setting assembly shown is used in conjunction with an actuator tool, not shown, which would typically be connected above the tool 10. Such an actuator can be of any design known in the art, such as but not limited to Downhole Power Units, electric line power units, gas-powered units, mechanical and electromechanical setting tools, etc. A mechanical setting assembly can be actuated by the weight-down of the tubing string, or by utilizing a setting tool connected to the tool mandrel for pulling upward on the mandrel to set the packer. The type and details of the setting assembly are not critical to the invention and the tool 10 can be modified as desired from the shown embodiment to allow for the use of different setting tools and mechanisms. The setting assembly shown in the embodiment in FIGS. 2-4 includes a piston 102, which moves relative to the mandrel 12 when fluid flows through inlet port 104 into and filling fluid chamber 106.

This invention provides a method to improve the reliability and efficiency of unsetting and retrieving the packer 10 by making it possible to reduce, relieve, or relax the compressive forces within the sealing assembly 40. The compressive forces on the sealing elements 42 are relaxed or released before attempting to unset either slip assembly. To this end, the tool 10 further includes a prop assembly 70 or sealing element retainer assembly 70, as seen in FIGS. 2-4. The prop assembly 70 includes a prop member 72, which moves relative to the sealing assembly 40 during the step of releasing or relaxing the sealing elements 42 of the sealing assembly 40 as will be described further herein. The prop assembly 70 further includes a releasable connector assembly 74 which operates to maintain the prop assembly components in run-in and set positions, then allow movement of the assembly parts during the process of relaxing the sealing elements 42.

A preferred embodiment is shown in FIGS. 2-4. The prop assembly 70 has a prop member 72, which abuts the upper end of the sealing element assembly 40. The prop member 72 is an annular sleeve, slidably mounted for longitudinal movement on the exterior surface of the mandrel 12. The prop member at its upper end abuts a releasable connector assembly 74. [The releasable connector assembly 74 includes a release mechanism 75. In the embodiment shown in FIGS. 2-4, the release mechanism is a collapsible C-ring having a threaded or toothed portion 76, which cooperates with a threaded or toothed portion 34 of the upper wedge assembly 30]. In the run-in position, seen in FIG. 1, the toothed portion of the collapsible C-ring 75 is in engagement with the toothed portion of the upper wedge assembly. The upper wedge assembly and prop assembly are thus connected and fixed in relative position to one another.

In the set position, as seen in FIG. 3, the sealing element retainer assembly 70 maintains its relative position with the upper wedge assembly 30 due to the interlocking toothed portions 76 and 34. Note, however, that both the upper wedge assembly 30 (after shearing of pin 26) and the prop assembly are free to move relative to the mandrel 12 during the setting process.

In the unset or released position, seen in FIG. 4, the releasable connector assembly 74 has released. The collapsible C-ring has collapsed into cooperating groove 78 in the mandrel 12 due to the relative motion of the mandrel 12 with respect to the prop assembly 70. Alternately, the groove 78 can be in a sleeve or other movable member of the tool designed to cooperate with the release mechanism. With the C-ring collapsed to a smaller diameter position in the groove 78, the cooperating toothed portions 34 and 76 are no longer in contact. In turn, this allows the prop member 72 to move with respect to the upper wedge assembly 30 and the mandrel 12. The prop member 72, as seen in FIG. 4, moves longitudinally with respect to the upper wedge assembly and telescopes with respect to a member of the upper wedge assembly 40. The relative movement of the prop member 72 with respect to the mandrel 12 and with respect to the sealing assembly allows the sealing elements 42 to longitudinally expand and radially contract, thereby releasing or relaxing the compression forces acting on the sealing elements 42.

The releasable connector assembly 74 can be of other design without departing from the spirit of the invention. For example, the releasable connector assembly can include a collet assembly with cooperating collet fingers and grooves or lips. The releasable assembly can further be a shearing mechanism, such as shear pins or rings, or the like. Other releasable connectors can be utilized as will be recognized by those of skill in the art.

In this preferred embodiment, the prop assembly has a prop member, which moves longitudinally upward to allow the sealing elements and assembly to relax. As those skilled in the art will recognize, the assembly can be arranged such that downward movement will affect relaxation of the sealing elements. Further, other movement and mechanical designs for the prop member can be employed. The key is that the prop assembly moves to allow the sealing assembly to relax. The prop assembly can allow the sealing elements to expand longitudinally, thereby contracting radially, as seen in the embodiment in FIGS. 2-4. Alternately, the prop assembly can allow for radial contraction of the sealing elements without allowing change in the length of the sealing assembly. Such a configuration is explained below with respect to FIG. 5. The movable prop member can be located above or below the sealing assembly, or can be located radially inward from the sealing elements. Other arrangements will be apparent to one skilled in the art.

The preferred embodiment described in detail above is but one method of reducing the compressive forces in the sealing elements before tool retrieval. In the above method, these compressive forces are reduced by the use of a sealing element retainer member 72 held in an extended position by a releasable connector assembly. The releasable connector is released by relative movement of the mandrel, which aligns a groove 78 with the release mechanism 75. In turn, this allows the prop member 72 to move longitudinally, thereby reducing the compression forces on the sealing elements. The sealing elements are free to longitudinally lengthen or expand, which results in radial contraction of the elements.

Figure 5:
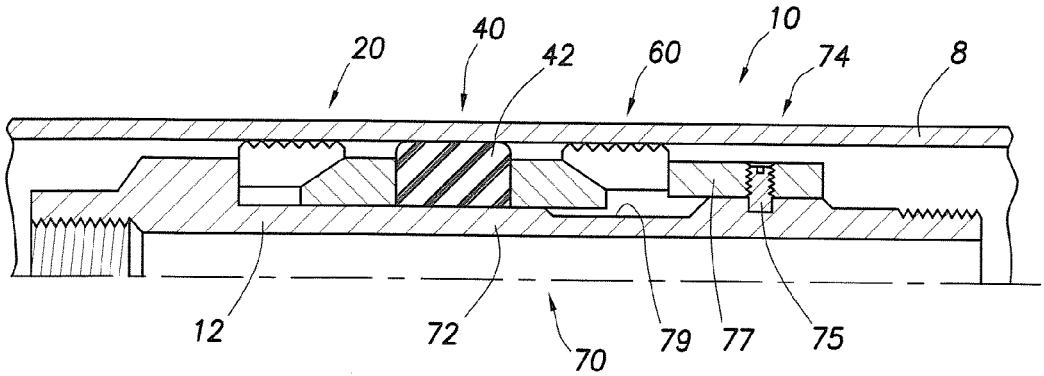
FIG. 5 is cross-sectional view of an alternate embodiment of an opposed slip type packer of an embodiment of the invention.

In another embodiment of this invention, illustrated in FIG. 5, the reduction in compressive forces in the sealing elements 42 is achieved by aligning a reduced diameter section 79 of the mandrel 12 with the sealing elements 42. In this case, the prop member 72 is a portion of the mandrel 12 which moves longitudinally with respect to the sealing elements 42 during the unsetting process. As the prop member 72, or mandrel portion, is moved relative to the sealing assembly 40 during the unsetting process, a reduced diameter portion 79 of the mandrel 12 is moved into longitudinal alignment with the sealing elements 42. With the additional radial space made available, the compression forces on the sealing elements 42 are reduced and the sealing elements contract radially to an unset position such that they are no longer in sealing engagement with the casing. The reduced diameter portion of the mandrel can alternately be provided on a separate movable member of the tool, such as on a sliding sleeve or the like.

Also illustrated in FIG. 5, is another type of releasable connector assembly 74. A sleeve 77 is mounted exterior to the mandrel and maintained in position with respect to the mandrel 12 by a release mechanism 75, here shown as a shear pin. While shown as a threaded shear pin, the releasable connector can be any other suitable releasable connector such as other shear devices, like shear rings, shafts or the like, or other releasable connectors such as a collet assembly or other mechanisms known to those working in the art. Similarly, any other releasable method common in the art, such as mechanical deformation, physical severing, etc. can be deployed without departing from the principles of this invention.

Alternatively to the embodiment shown in FIG. 5, a collapsible surface can be provided for the interior surfaces of the sealing elements 42. A reduced diameter portion of the mandrel (or sleeve or the like) is moved into alignment with the collapsible surface. When the collapsible surface collapses to a smaller diameter, the sealing elements also radially contract, thereby relaxing the sealing elements. The collapsible surface can be a split sleeve, a plurality of split rings, wedge shaped segments, etc. Other mechanical arrangements will be apparent to those skilled in the art to allow the sealing elements to radially contract.

In use, the tool 10 is lowered into a subterranean wellbore having a casing. Then, the tool 10 is set using a setting assembly, such as the hydraulic setting assembly 100 shown. While the tool 10 is held in position by a tubing string or the like, hydraulic fluid is forced by an actuator tool (not shown) through the inlet port 104 into the fluid chamber 106, thereby forcing the piston 102 upward. The upward movement of the piston 102 forces the lower slip support 65, the lower wedge assembly 30, and the lower slip assembly 60 upward. Upward movement of the lower wedge assembly 60 compresses the sealing assembly 40. The sealing elements 42 are moved to a set position, radially expanded and longitudinally shortened, wherein the sealing elements of the sealing assembly sealingly engage the wellbore casing. Further, the upper 20 and lower 60 slip assemblies move longitudinally relative to their respective wedge assemblies 30 and 50. The slip assemblies, and in particular the slip elements, are radially expanded into a set position in gripping engagement with the casing. The timing and relative motions of these elements of the tool during setting are controlled by use of shear pins and the like as is known in the art and not detailed here.

The tool 10 is then in a set position, the sealing assembly providing an annular seal between the mandrel and casing, and the slip assemblies providing a gripping engagement with the casing. The tool can be left in place in the set position as desired. During operations in the wellbore, the differential pressure across the tool may alternate, resulting in the cinching-up described elsewhere herein.

Figure 4A:
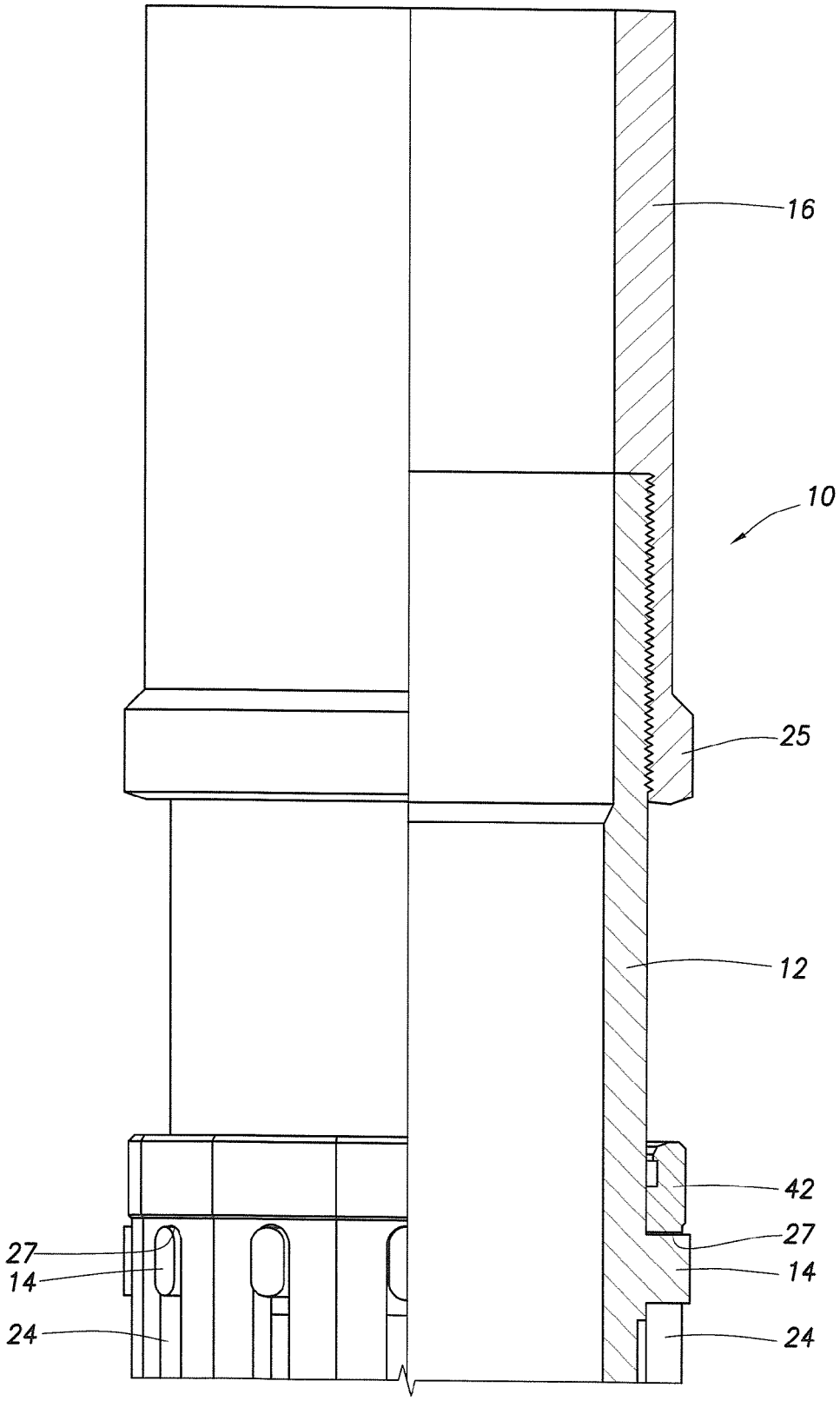
FIGS. 4A-4F are partial cross-sectional views of an opposed slip type tool of an embodiment of the invention in an unset or released position.
Figure 4B:
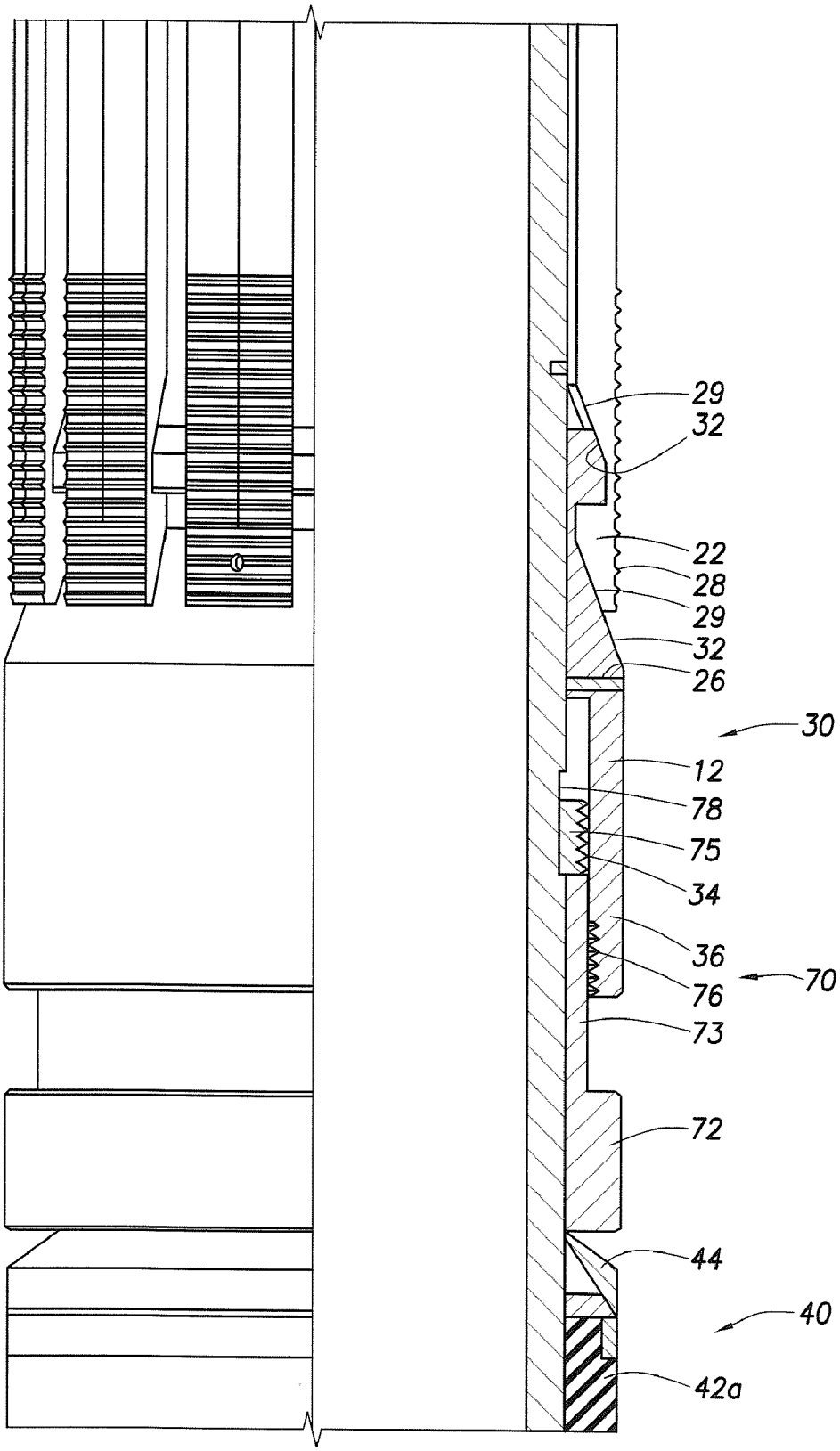
Figure 4C:
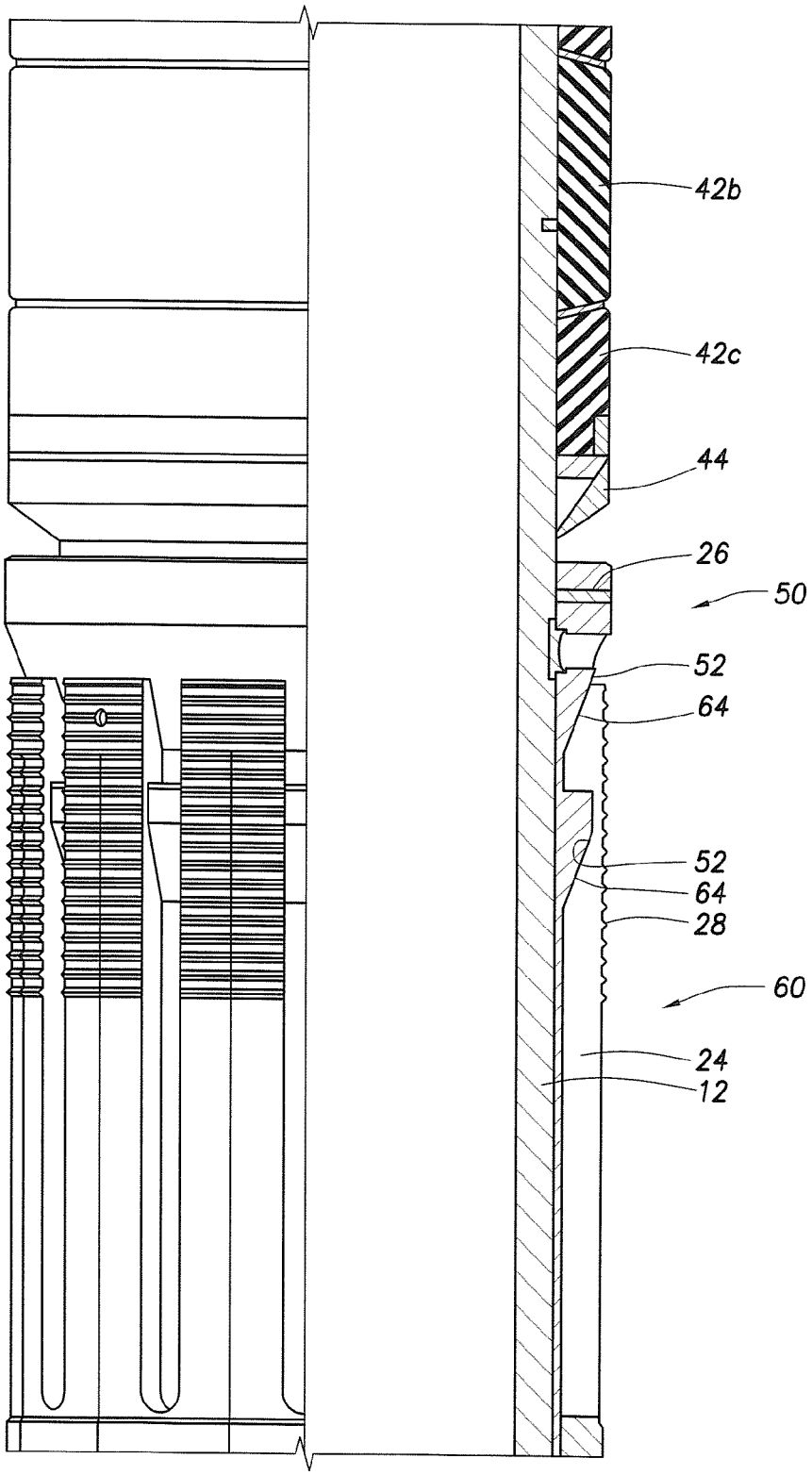
Figure 4D:
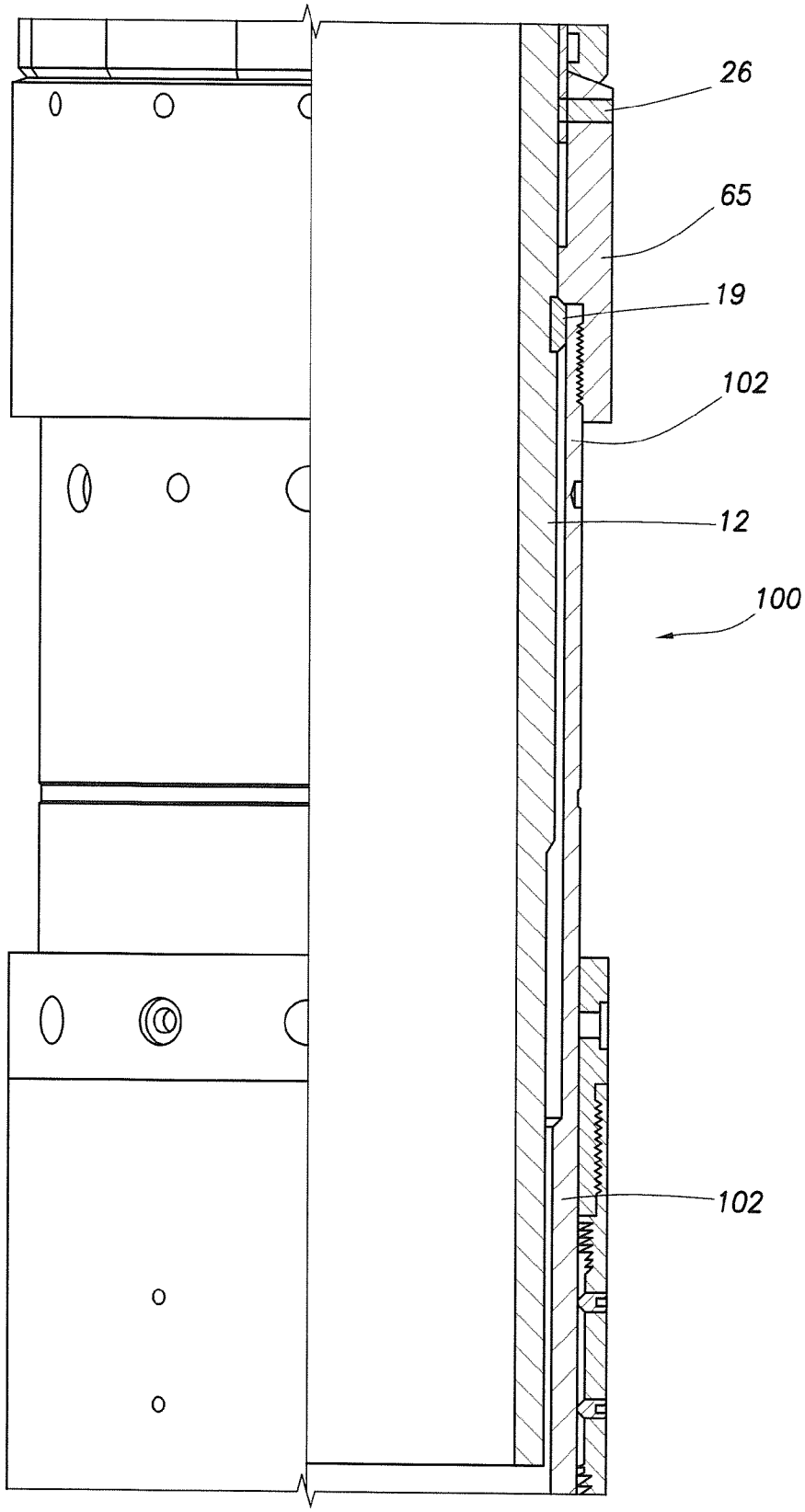
Figure 4E:
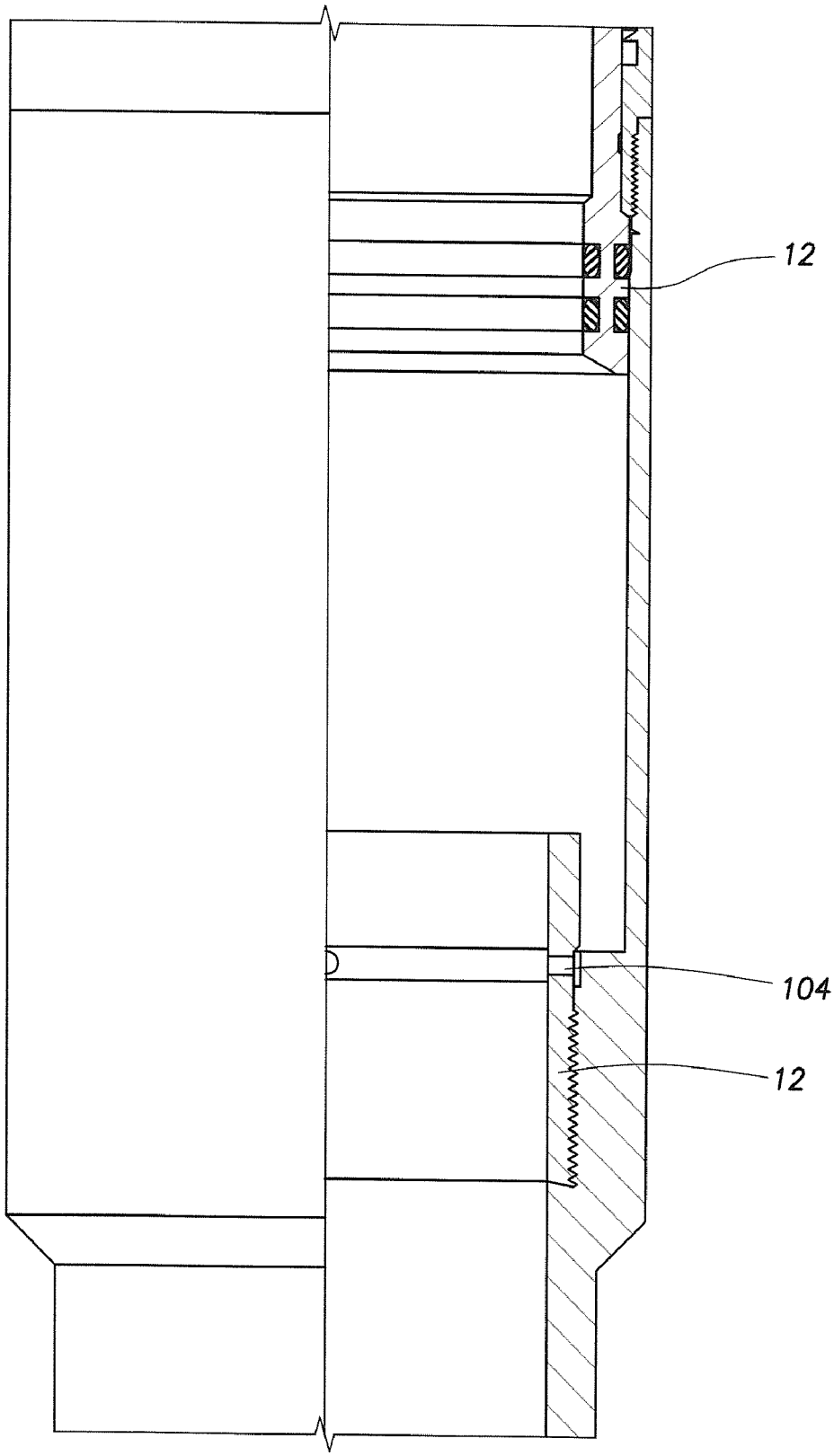
Figure 4F:
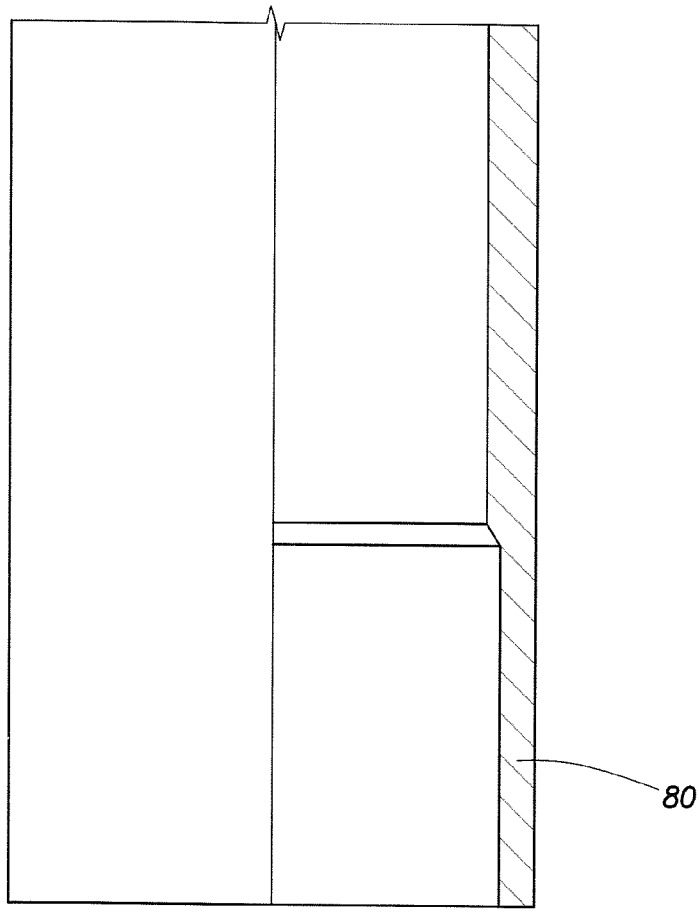

To unset and retrieve the tool 10, the mandrel 12 is moved longitudinally upward relative to the set slip and sealing assemblies. For example, a retrieving tool is run into the wellbore on a tubing string or coiled tubing and connected to the upper sub 16 of the tool. In the embodiment illustrated in FIG. 4E, the mandrel 12 is freed to move longitudinally relative to the slip and sealing assemblies by cutting the mandrel circumferentially at a location below the sealing and slip assemblies. A cut 15 is seen at FIG. 4D. The cutting is done by a cutting tool, such as chemical cutter. It should be understood, however, that any number of other suitable means of disconnecting the mandrel can be deployed to cut the mandrel without departing from the principals of the present invention. Such other means to disconnect the mandrel may include, severing by abrasion, laser cutting, shaped-charges, selective placement of acid or corrosive material, or releasing of one or more releasable devices such as shear pins, etc. Likewise, the location of the cut or disconnect can be changed without departing from the principles of this invention.

Further upward movement of the mandrel disengages the sealing elements 42 from the casing by relaxing the compression forces on the sealing elements 42. The mandrel 12 is moved upwardly relative to the slip and wedge assemblies, sealing assembly, and prop assembly. As the mandrel is pulled upward, the groove 78 on the mandrel 12 moves into alignment with the releasable mechanism 75. The collapsible C-ring 75 collapses, or radially contracts, into the groove 78, thereby releasing the interlocking toothed portions 76 and 34 of the releasable connector 75 and upper wedge assembly 30, respectively. Consequently, the prop member 72 is able to move relative to the upper wedge assembly. An arm 73 of the prop member 72 telescopes with a corresponding arm 36 of the upper wedge assembly 30, as seen in FIG. 3. The prop member 72 moves longitudinally away from the lower wedge assembly 60, thereby allowing longitudinal expansion of the sealing elements 42. The longitudinal expansion of the sealing elements 42 reduces the compression forces in the sealing assembly and the sealing assembly radially contracts, disengaging from the casing.

Figure 3A:
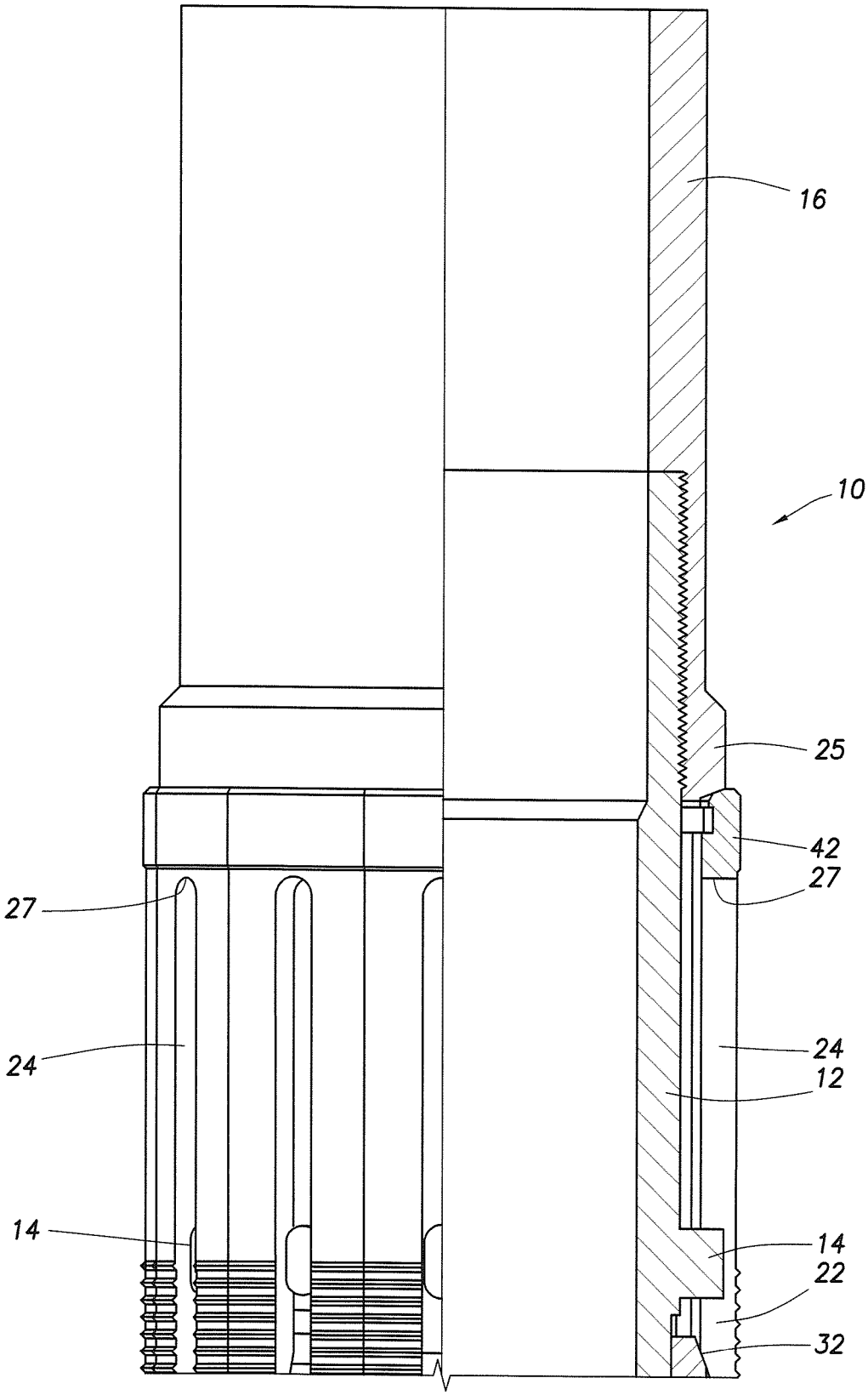
FIGS. 3A-3E are partial cross-sectional views of an opposed slip type tool of an embodiment of the invention in a set position.
Figure 3B:
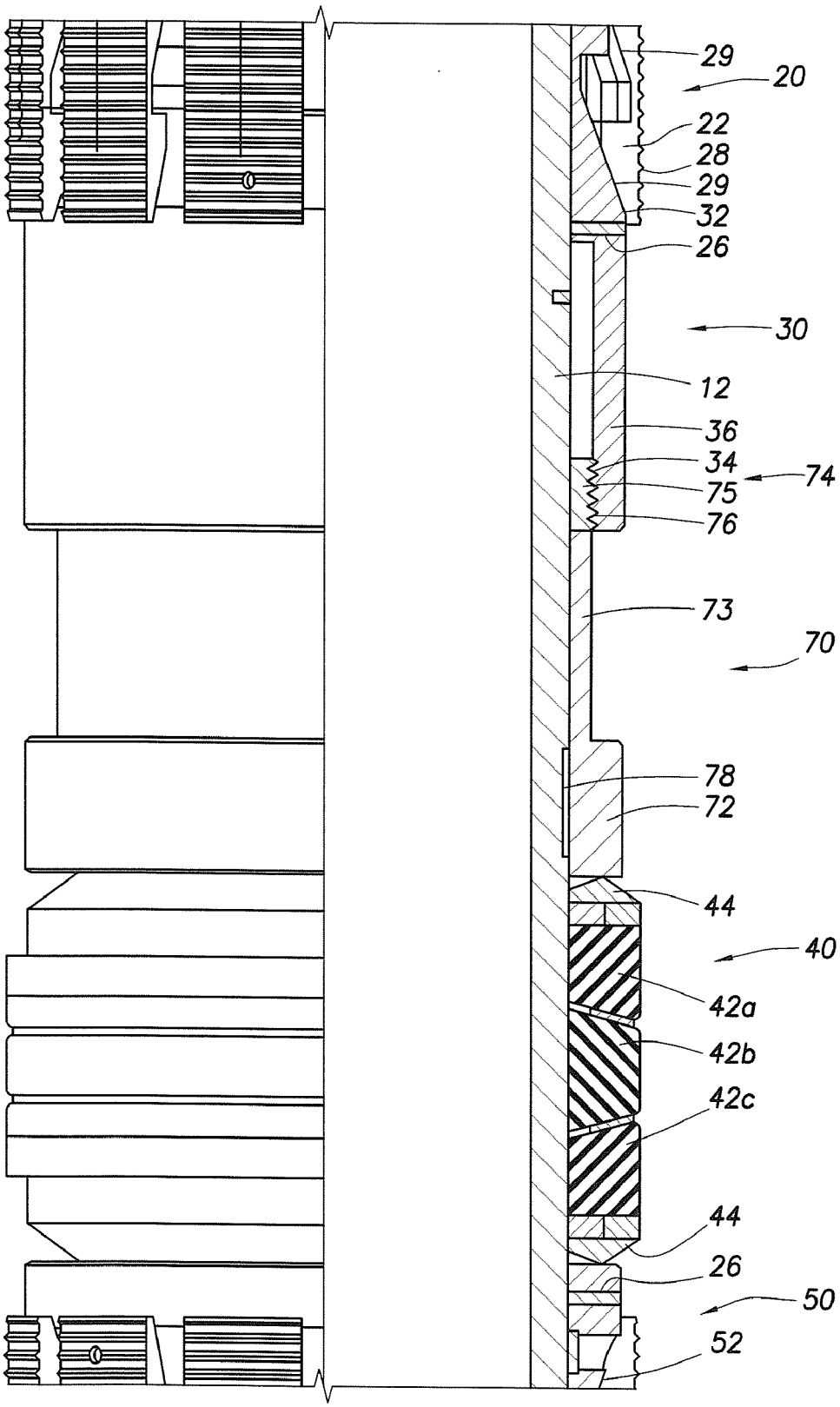
Figure 3C:
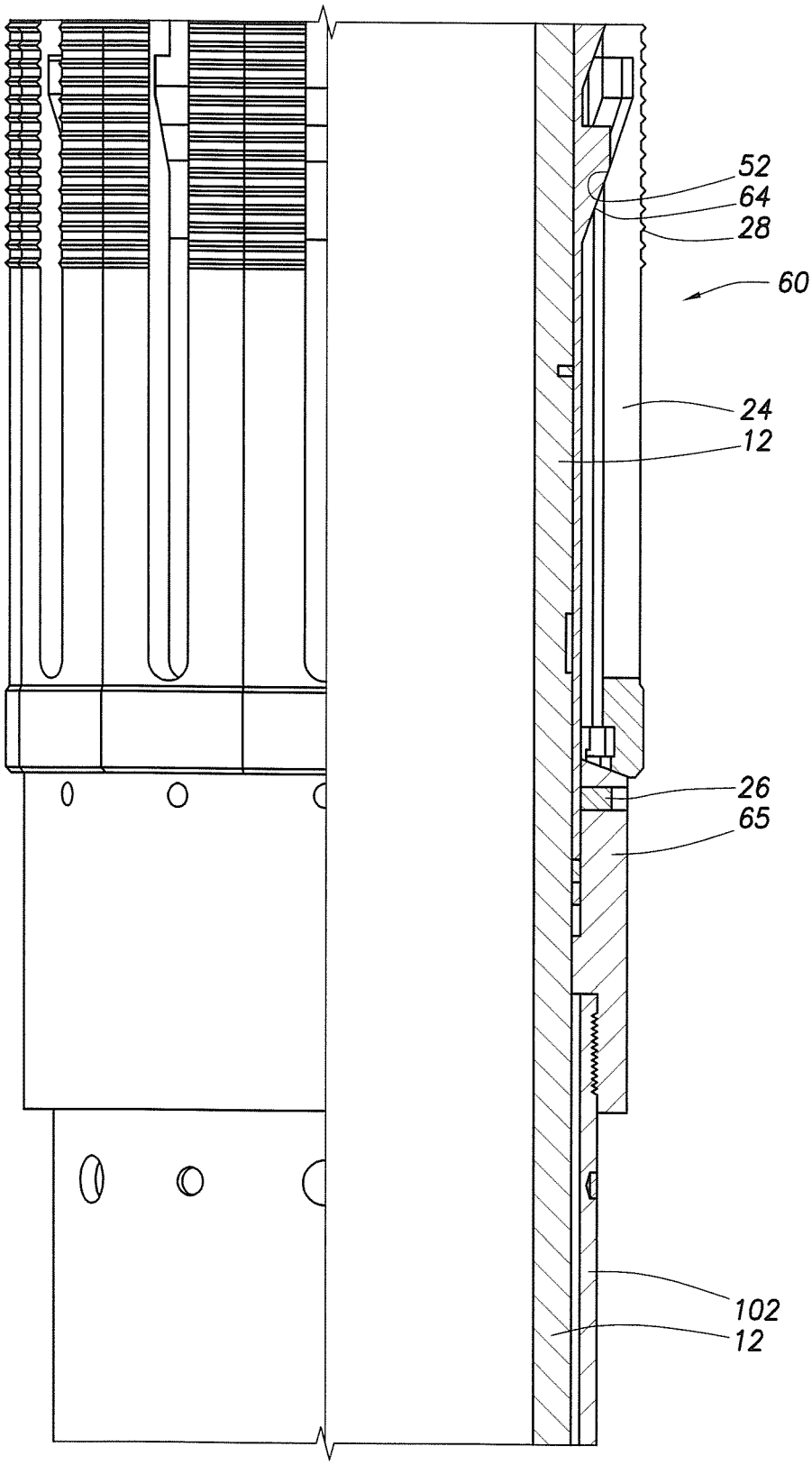

After the step of disengaging the sealing assembly, the slip assemblies are disengaged from gripping engagement with the casing. In the embodiment shown, the upper slip assembly 20 is mechanically unset by pulling the upper slips off the upper wedge. Further upward movement of the mandrel 12 moves the lugs 14 into contact with the upper ends 27 of the slots 24 of the upper slip assembly 20 as seen in FIG. 3A. The lugs 14 pull the upper slip assembly off the upper wedge assembly 30, thereby unsetting the upper slip assembly and disengaging the upper slip assembly from the casing, such that the slip assembly is no longer in gripping engagement with the casing.

In the embodiment shown, the lugs contact the closed ends of the slots simultaneously, thereby pulling the slip elements off the wedge at approximately the same time. It is to be understood, however, that simultaneous or sequential unsetting of the slip elements can be performed. Sequential unsetting of the slip elements may be preferred where the slip assembly has a plurality of separated slip elements. Such methods are known in the art and taught in U.S. patents incorporated herein, for example.

Further, in the preferred embodiment, the lower slip assembly is then unset and disengaged from the casing due to further upward movement of the mandrel 12, which will result in the lower slip assembly being pulled off the lower wedge assembly 60. After the compression forces are released in the sealing assembly and the upper slip assembly is unset, there are no remaining compression forces maintaining the lower slips on the lower wedge. Upward movement of the tool will drag the lower slips downward and off the lower wedge.

The upper slip assembly is preferably unset and disengaged, as illustrated, before the lower slip assembly is unset and disengaged. However, the particular order can be reversed or the slip assemblies can be disengaged simultaneously.

Figure 3D:
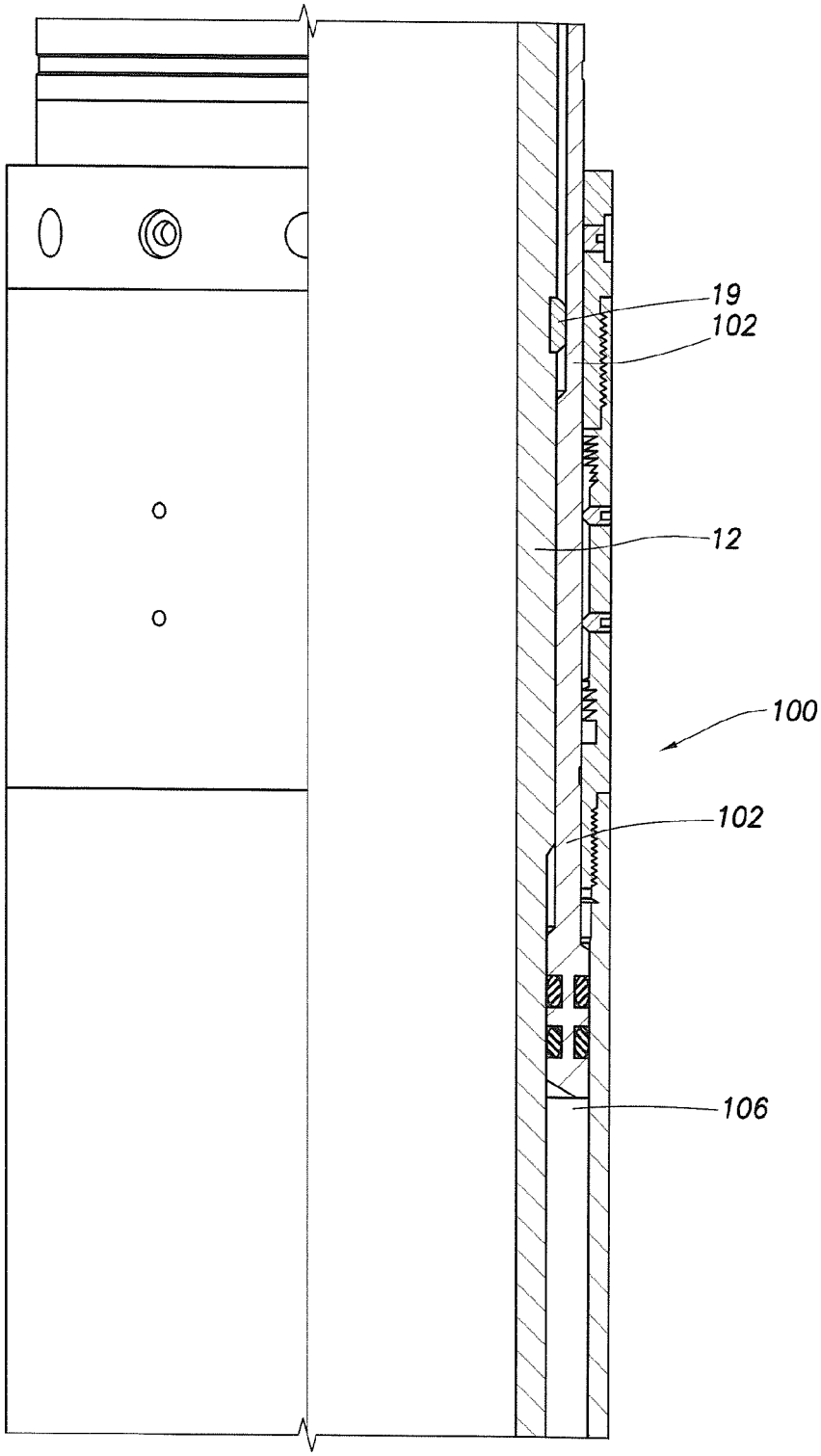
Figure 3E:
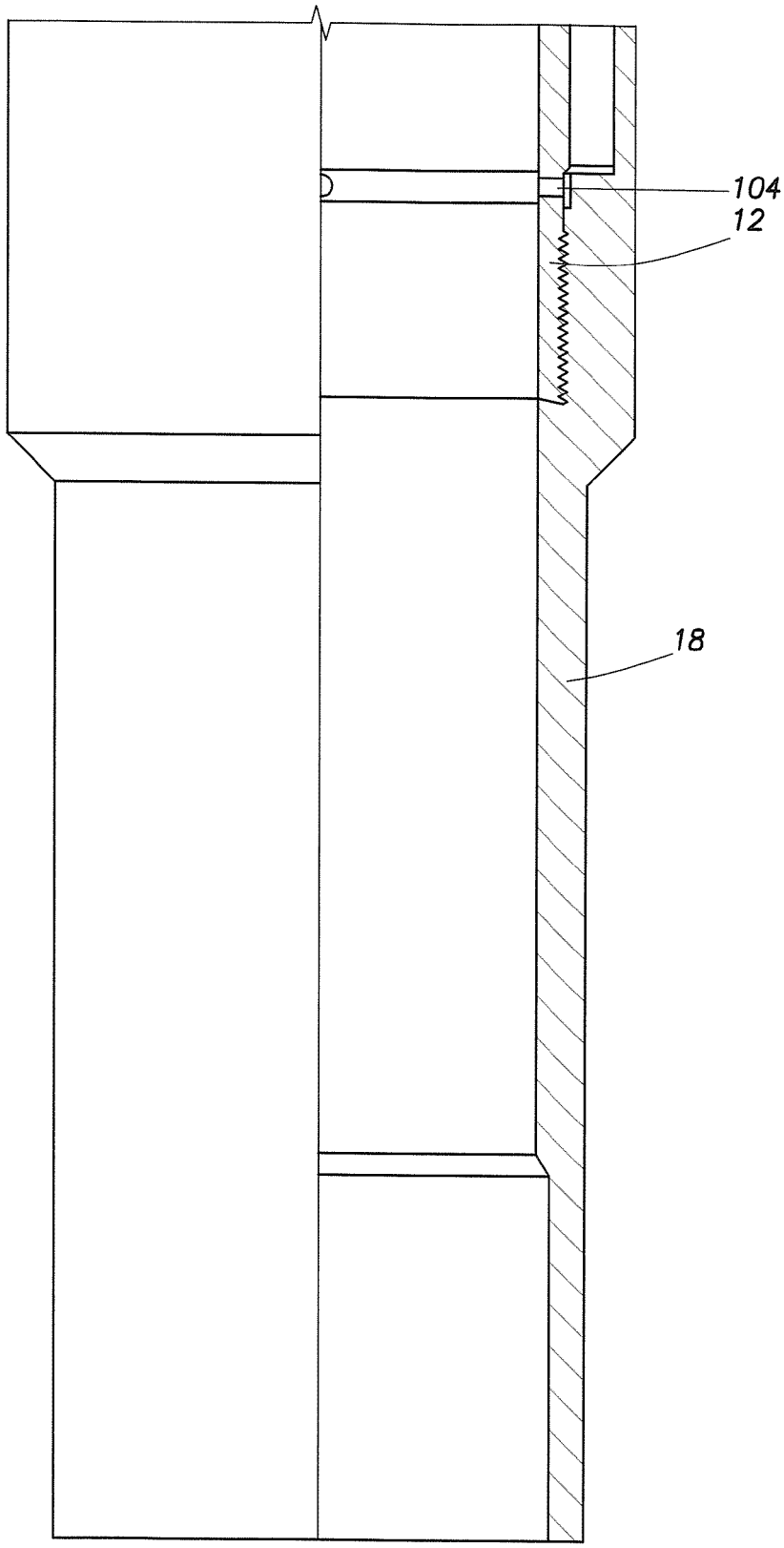

Finally, a lower catch mechanism 19, such as shown in FIG. 3D, abuts the lower slip support 65 and the entire tool 10 is retrieved from the wellbore. The lower end of the tool can alternately be dropped into the wellbore, but this is not preferred.

Finally, the tool 10 is then retrieved from the wellbore by continuing to pull the toll upward toward the surface.

A similar method is utilized in relation to the embodiment of the tool shown in FIG. 4. The tool 10 in FIG. 4 is shown in a set or engaged position, with the upper slip assembly 20 and lower slip assembly 60 in a radially expanded position and in gripping engagement with a casing 8. The mandrel 12 is pulled upward, by a tubing string, coil tubing, work string or the like. The upward movement of the mandrel 12 releases the releasable mechanism 75, here shown as a shear pin. The mandrel 12 is now free to move longitudinally with respect to the upper and lower slip assemblies, wedge assemblies, and sealing assembly. A portion of the mandrel 12 acts as the prop member 72 of the prop assembly 70. A first portion of the mandrel props up, or supports, the interior surface of the sealing element 42. As the mandrel is pulled upwardly, a reduced diameter portion 79 of the mandrel is moved into alignment with the sealing element 42. The sealing element 42 is then able to contract radially, thereby releasing or relaxing the compressive forces on the sealing element. The sealing element 42 disengages from the casing 8. Further upward movement of the mandrel results in unsetting the upper slip assembly by the methods described above and not repeated here. The lower slip assembly is also unset, and the tool is retrieved from the wellbore.

The wellbore tool used above to describe the principles of this invention is a packer. Any other wellbore tool set with opposed slips can be substituted for the packer without departing from the principles on this invention. Likewise, the wellbore envisioned in the above description may be used for any purpose, such as, production, injection, observation, testing, etc., without departing from this invention's principles.

The principles of this invention would also apply if the sealing and/or gripping assemblies were comprised of inflatable components. While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method of utilizing an opposed-slip type downhole tool in a subterranean wellbore having a casing, the method comprising the steps of:

positioning the tool in a subterranean wellbore, the tool having an upper slip assembly and a lower slip assembly positioned on opposite sides of a sealing assembly, the sealing assembly having at least one compressible, annular sealing element;

setting the tool in the wellbore by radially expanding the slip assemblies into gripping engagement with the casing, and by longitudinally compressing and radially expanding the sealing element into sealing engagement with the casing;

unsetting the tool in the wellbore by doing the following steps, in the order presented:

a. first, disengaging the sealing element from the casing by relaxing the compression forces on the sealing element; and then b. second, disengaging one of the slip assemblies from the casing such that the slip assembly is no longer in gripping engagement with the casing; and retrieving the tool from the wellbore.

2. The method of claim 1, wherein the step of disengaging one of the slip assemblies comprises disengaging the upper slip assembly by moving a tool mandrel in a first direction with respect to the one slip assembly, and further comprising the step of further moving the tool mandrel in the first direction until the tool mandrel contacts a member of the one slip assembly; and further comprising the step of further moving the tool mandrel in the first direction, thereby disengaging the one slip assembly from the casing.

3. The method as in claim 2, further comprising the step of disengaging the lower slip assembly from the casing after the step of disengaging the upper slip assembly from the casing, and wherein the lower slip assembly is disengaged by further movement of the tool mandrel in the first direction.

4. The method as in claim 2, wherein the upper slip assembly is a barrel slip assembly.

5. The method as in claim 4, wherein the step of disengaging the upper slip assembly includes the step of moving lugs into contact with a portion of the upper slip assembly and moving the upper slip assembly upward, thereby disengaging the upper slip assembly from the wellbore casing.

6. The method as in claim 1, wherein the step of disengaging the sealing element includes radially contracting the sealing element.

7. The method as in claim 1, wherein the step of disengaging the sealing element includes longitudinally lengthening the sealing element.

8. The method as in claim 1, wherein the step of disengaging the sealing element further comprises moving a sealing element retainer to reduce the compression forces on the sealing element.

9. The method as in claim 8, wherein the sealing element retainer is moved longitudinally, the longitudinal movement of the sealing element retainer relaxing the longitudinal compression on the sealing element.

10. The method as in claim 9, wherein the sealing element retainer moves longitudinally upward during the step of disengaging the sealing element.

11. The method as in claim 10, wherein the sealing element retainer is an annular member in sliding engagement with a mandrel of the tool, the sealing element retainer connected to an upper wedge of the upper slip assembly by a releasable connection, and wherein the sealing element retainer is released to move with respect to the upper wedge during the step of disengaging the sealing element.

12. The method as in claim 11, wherein the releasable connection includes a toothed, collapsible C-ring, the teeth of which engage a corresponding toothed portion of the upper wedge assembly, the C-ring cooperating with and collapsing into a reduced-diameter portion of the outer surface of the tool mandrel during the step of disengaging the sealing element.

13. The method as in claim 8, wherein the sealing element has an interior surface, and wherein the sealing element retainer provides compression force, when the tool is set, acting on the interior surface of the sealing element.

14. The method as in claim 13, wherein the sealing element retainer is moved longitudinally during the step of disengaging the sealing element, the movement of the retainer relaxing the compression force acting against the interior surface of the sealing element.

15. The method as in claim 8, wherein the tool further comprises a mandrel, and wherein the sealing element retainer is a portion of the tool mandrel.

16. The method as in claim 15, wherein the tool mandrel has a reduced-diameter portion which is moved into alignment with the sealing element during the step of disengaging the sealing element, thereby reducing the compression force on the sealing element and allowing the sealing element to relax.

17. The method as in claim 1, wherein the tool includes a tool mandrel, and further comprising the step of cutting the mandrel.

18. The method as in claim 1, wherein the tool includes a mandrel and a sleeve connected to one another by a releasable connection, and wherein the mandrel and sleeve are released to move relative to one another during the step of disengaging the sealing element.

19. The method as in claim 1, wherein the sealing assembly includes multiple sealing elements.

20. The method as in claim 1, wherein the step of setting the tool further comprises setting the tool using a hydraulic assembly.

* * * * *